United States Patent [19]

Kindler

[11] 4,337,848

[45] Jul. 6, 1982

[54] START CONTROL DEVICE, ESPECIALLY FOR AN ELEVATOR

[75] Inventor: Gerhard Kindler, Meggen, Switzerland

[73] Assignee: Inventio AG, Hergiswil, Switzerland

[21] Appl. No.: 252,877

[22] Filed: Apr. 10, 1981

[30] Foreign Application Priority Data

Apr. 21, 1980 [CH] Switzerland ..... 3056/80

[51] Int. Cl.[3] ..... B66B 1/32

[52] U.S. Cl. ..... 187/29 R

[58] Field of Search ..... 187/29

[56] References Cited

U.S. PATENT DOCUMENTS

| | | | |
|---|---|---|---|
| 3,507,360 | 4/1970 | Ostrander et al. | 187/29 |
| 3,614,996 | 10/1971 | Saito et al. | 187/29 |
| 3,847,251 | 11/1974 | Maltby et al. | 187/29 |
| 3,902,572 | 9/1975 | Ostrander | 187/29 |
| 4,042,068 | 8/1977 | Ostrander et al. | 187/29 |

*Primary Examiner*—J. V. Truhe
*Assistant Examiner*—W. E. Duncanson, Jr.
*Attorney, Agent, or Firm*—Werner W. Kleeman

[57] ABSTRACT

With this start-up control apparatus it is intended to reduce the starting jerk at elevators resulting from superimposing the motor cut-on moment and load moment and to improve the starting comfort of the elevator passengers. The brake magnet of the electromechanical holding brake of the elevator is connected for this purpose with a regulation device, by means of which there can be linearly decreasingly controlled the braking force during the elevator's start-up, so that there can be obtained a linearly ascending start-up moment of the drive. The linear decrease of the braking force first appears following decay of the cut-on moment peak of the drive motor. This can be obtained by optimum correlation of the start-up time point of a reference value transmitter of the regulation device and the drive motor as well as the proportional part (P-part) of the reference value transmitter, whose transfer function approximately corresponds to the time behavior of a PI-regulator. The cut-on moment peak can only have an inappreciable effect, since the brake spring is dimensioned such that the mechanical brake moment amounts to 3-fold to 3.5-fold of the motor rated moment or torque.

7 Claims, 5 Drawing Figures

START CONTROL DEVICE, ESPECIALLY FOR AN ELEVATOR

BACKGROUND OF THE INVENTION

The present invention generally relates to elevator or lift systems and, in particular, concerns a new and improved construction of a start control device or apparatus, especially for an elevator or the like.

The start-up control apparatus of the present development is of the type comprising a drive motor which can be turned-on by means of the closing contacts of a mains or primary protection circuit and an electromechanical holding brake which contains at least one brake magnet and a brake spring. One terminal of the brake magnet is connected by a closing contact of a brake protection circuit with one terminal or pole of a voltage source. The brake magnet, upon turning-on the elevator drive, is energized and the holding brake is lifted or opened against the force of the braking spring.

Simple, economical elevator systems which are driven by asynchronous motors do not possess any inherent start-up control devices. With such type elevator systems known from prior art publications, for instance Bethmann "Der Aufzugsbau," the brake magnet of an electromechanical holding brake is energized by the contacts of the primary protection of the drive motor. Lifting or opening of the holding brake against the action of a weight or a spring occurs, in this case, suddenly upon cutting-in the drive motor. The start-up comfort of such type of elevators is insufficient, since the starting jerk becomes markedly discernable due to the sudden lifting of the brake and the immediate or sudden superimposing of the motor start-up torque or moment and the load moment or torque.

Additionally, it is known in this technology to energize the brake magnets of the holding brake during the elevator start-up by means of the closing contact of a brake protection or brake protection circuit. Thus, for instance, in German Pat. No. 1,091,303 there is disclosed an apparatus wherein the brake protection circuit is energized, upon cut-on, with the aid of an auxiliary contact of the mains protection circuit of the drive motor. As a result there is realized a certain operational integrity or reliability, since the holding brake is first opened or lifted when the drive is turned-on. Additionally, with such an arrangement it is possible to control completely independently of one another the brake and drive motor during the deceleration phase of the elevator. With the state-of-the-art equipment there automatically occurs a delay between the cut-on time point and the start of brake lifting, so that it is not possible however to obtain any appreciable improvement in the start-up comfort.

On the other hand, it is known in this technology to employ an electromechanical holding brake for the regulated braking of an elevator during the deceleration phase for the purpose of exactly stopping the elevator at the required floor or storey of the building or structure. Thus, for instance, the brake apparatus disclosed in German Pat. No. 2,003,951 possesses a regulation circuit embodying a tachometer dynamo forming an actual value from the rotational speed of a shaft which is to be braked, a reference value transmitter containing the braking program, a regulation or control amplifier for comparison of the actual and reference values as well as an adjustment or setting element acting upon a brake magnet.

SUMMARY OF THE INVENTION

Therefore, with the foregoing in mind it is a primary object of the present invention to provide a new and improved start control device, especially for an elevator, which is not associated with the aforementioned drawbacks and limitations of the prior art constructions.

Another and more specific object of the present invention aims at providing a cost favorable start-up control device for an elevator, by means of which it is possible to appreciably improve the start-up comfort.

Yet a further significant object of the present invention is to provide a new and improved construction of start-up control apparatus for an elevator system, which is relatively simple in design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the start control apparatus of the present development is manifested by the features that the brake magnet of the holding or holder brake is connected with a regulation device, by means of which the braking force, during elevator start-up, can be controlled so as to decrease linearly and there can be obtained a linearly ascending start-up moment of the drive. The linear decrease of the braking force first prevails following the decay of the cut-on moment peak of the drive motor. This can be obtained by optimum mutual coordination or correlation of the starting time point of the reference value transmitter of the regulation device and the drive motor as well as the P-part of the reference value transmitter. The cut-on moment peak only has an inappreciable effect due to the optimum designed braking or brake spring.

The advantages which can be realized when practicing the invention predominantly reside in the fact that the start-up jerk of the elevator, resulting from superimposing the motor cut-on moment and the load moment, can be markedly reduced, and after the decay of the cut-on moment until complete lifting of the holding brake the acceleration change is approximately constant.

As a result the start-up jerk can be further appreciably reduced and there can be obtained a notable improvement in the start-up comfort. A further advantage resides in the proposed construction or configuration of the regulation device, which possesses all of the advantages of electronic devices, such as, by way of example and not limitation, no parts subject to wear, maintenance-free design, easy adjustability, long-time stability and relatively low cost.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
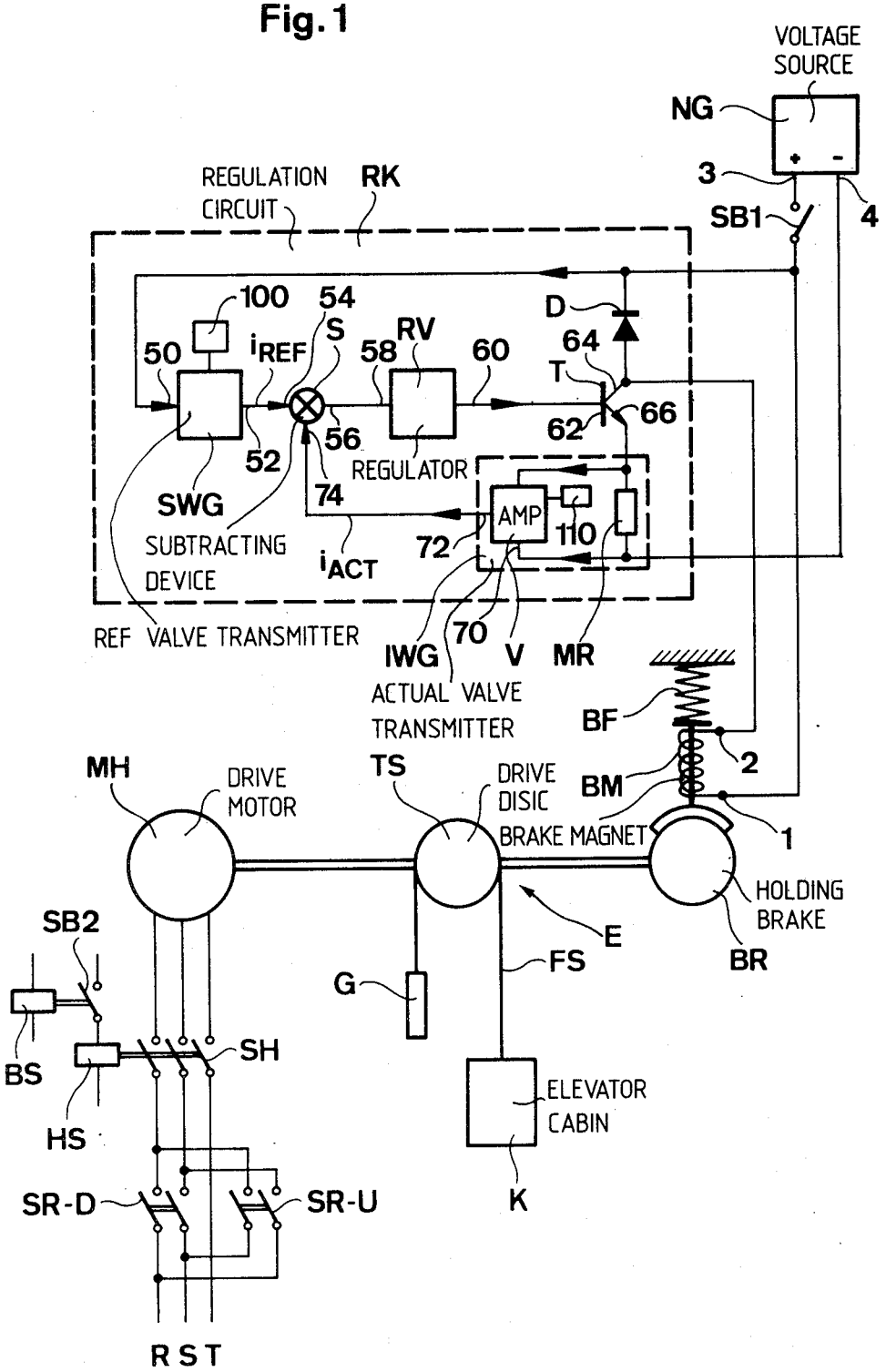
FIG. 1 is a schematic illustration of a start control apparatus or device for a transportation system, such as an elevator or the like, according to the invention.

Describing now the drawings, it is to be understood that only enough of the construction of the transportation installation, such as an elevator, with which the inventive start control device can be employed, has been shown to simplify the drawings while enabling those skilled in the art to readily understand the underlying principles and concepts of the present development. Turning attention now to FIG. 1, reference character MH designates the drive motor of an elevator installation or system, generally indicated by reference character E, which drives, by means of a drive disk TS an elevator cabin K which is suspended at a conveying element FS, such as cable means as is known in the art. The elevator cabin K is balanced by a counter weight G. The elevator drive motor MH, for instance an asynchronous motor, is connected with a three-phase power supply network RST by means of closing contacts SH of a main protection HS and closing contacts SR-D, SR-U of two not particularly illustrated directional protections or protection devices. So that the start-up current does not become too great the asynchronous motor MH is preferably pole-switchable and designed to have six and four poles. An electromechanical holding or holder brake BR possesses at least one brake magnet BM and a brake spring BF. The electromechanical holding brake BR acts upon the driving disk or pulley TS and the drive motor MH. One terminal 1 of the brake magnet BM is connected by means of a closing contact SB1 of a brake protection BS with the one terminal 3 of a direct-current voltage source NG and the other terminal 2 of the brake magnet BM is connected with a regulation device or circuit RK which will be described more fully hereinafter. The brake protection BS possesses a further closing contact SB2, by means of which there can be energized the mains or primary protection HS.

The regulation circuit or device RK consists of a reference value transmitter SWG, an actual value transmitter IWG, a subtractor of subtracting device S forming a regulation deviation, a two-point regulator RV and a switching transistor T serving as an adjustment or setting element.

The reference value transmitter SWG is an operational amplifier which is programmed by external structural components, such as RC-elements, generally indicated by reference character 100, in such a manner that its transfer function approximately corresponds to the time behaviour of a PI-regulator. The one input 50 of the reference value transmitter SWG is connected by means of the closing contact SB1 of the brake protection BS with the one terminal or pole 3 of the direct-current voltage source NG, whereas its output 52 is connected with the input 54 of the subtracting device S.

The subtracting device or unit S is an operational amplifier which amplifies the difference between the reference value $i_{REF}$ and the actual value $i_{ACT}$, and the output 56 of which is connected with the input 58 of the two-point regulator RV. This two-point regulator RV, an operational amplifier working as a switch, is connected by means of its output 60 with the base 62 of the switching transistor T. The collector 64 of the switching transistor T is connected with the other terminal 2 of the brake magnet BM, and between both terminals 1 and 2 of the brake magnet BM there is connected a diode D.

The actual value transmitter IWG consists of an amplifier V and a measuring resistance or resistor MR, where in this measuring resistance MR is connected at one terminal with the emitter 66 of the switching transistor T and the one input 68 of the amplifier V. The other terminal or end of the measuring resistance or resistor MR is connected with the other terminal 4 of the direct-current voltage source NG and with the other input 70 of the amplifier V. The amplifier V is an operational amplifier which can be programmed by external structural elements, such as RC-elements, generally indicated by reference character 10, in such a manner that the freewheeling current flowing during the blocking time of the switching transistor T through the brake magnet BM and the diode D is simulated and amplified. The output 72 of the actual value transmitter IWG is connected with the input 74 of the subtracting unit or device S.

Having now had the benefit of the foregoing description of an exemplary embodiment of start control apparatus according to the invention its mode of operation will now be considered and is as follows:

Upon giving a travel command, for instance for upward travel of the elevator cabin K, the appropriate directional protection is energized and the related closing contacts SR-U closed. By means of a not particularly illustrated but conventional auxiliary contact of the protection device the brake protection BS is energized, so that the closing contact SB1 is closed (time I, FIG. 5). By means of the further closing contact SB2 of the brake protection BS there is energized the mains or primary protection HS, whereupon the closing contacts SH are closed and the drive motor MH begins to run (time II, FIG. 4). Without resorting to the use of the inventive start control apparatus the start moment or torque then would extend in the manner portrayed by the curve TM (FIGS. 2 and 4).

Figure 4:
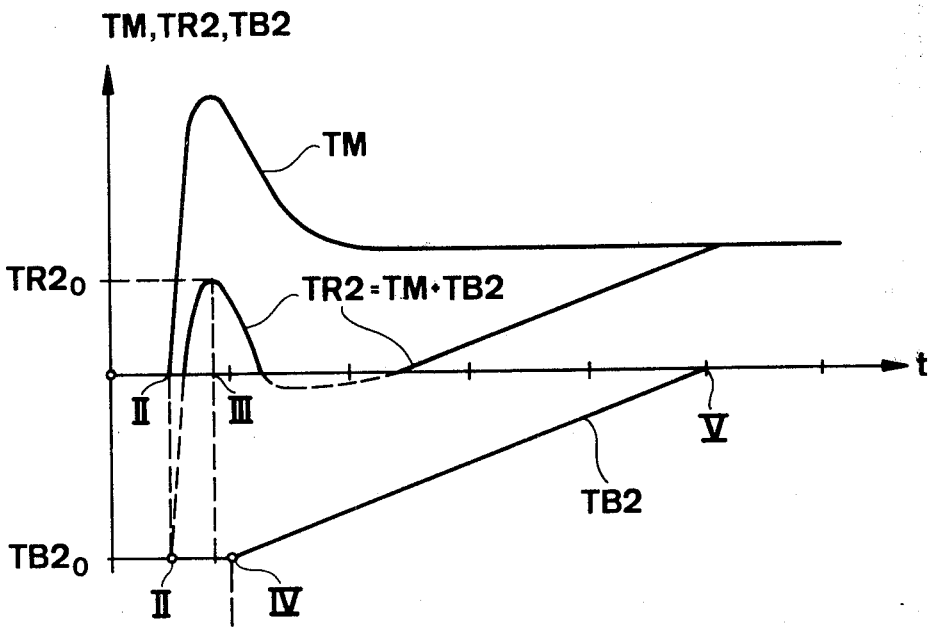
FIG. 4 is a diagram of the course of the moment when using the start or start-up control apparatus of the invention.

The incipiently present brake moment $TB2_o$, corresponding for instance to three times the motor rated moment TMN, opposes the start moment TM, so that there is only effective a small rotational moment or torque peak $TR2_o$ which acts to a slight degree upon the start-up comfort (time III, FIG. 4). Upon closing the contact SB1 of the brake protection BS the reference value transmitter SWG is placed into operation, and there appears at its output 52 a current reference value $i_{REF}$ corresponding to the P-part of the transfer function (time I, FIG. 5). Since at this point in time the current actual value $i_{ACT}$ delivered by the actual value transmitter IWG practically amounts to null, the regulation deviation becomes so great that the output voltage of the subtracting unit S exceeds a first threshold. Consequently the output voltage of the two-point regulator RD jumps to a value which causes the switching transistor T to be controlled so as to be in its conductive state or mode. The ascending current flowing now through the brake magnet BM and the switching transistor T is detected by the actual value transmitter IWG by means of the measuring resistance MR and infed to the subtracting unit S as the current actual value $i_{ACT}$. Upon approach of the current actual value $i_{ACT}$ to the current reference value $i_{REF}$, which in the meantime has linearly ascended, the output voltage of the subtracting unit S falls below a second threshold. The output voltage of the two-point regulator RV jumps back to the original value and the switching transistor T is controlled back into its non-conductive state. The diminishing freewheeling current flowing through the brake magnet BM and the diode D is simulated in the actual value transmitter IWG and is delivered as the current actual value $i_{ACT}$ to the subtracting unit or device S. Now if the current actual value $i_{ACT}$ decreases to such an extent that the output voltage of the subtracting unit S again exceeds the first threshold or threshold value, then the switching transistor T is controlled again into its conductive state, whereupon the previously described operations repeat. The mean value of the current actual value $i_{ACT}$, which is proportional to the mean value of the excitation current $i_{err}$ flowing through the brake magnet BM, in this manner follows the linearly ascending current reference value $i_{REF}$ (FIG. 5).

Figure 5:
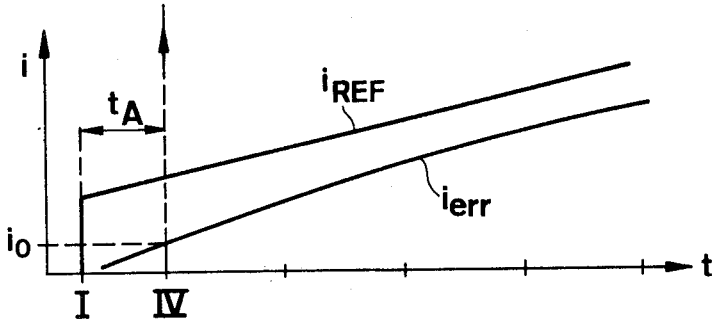
FIG. 5 is a diagram of the transfer or transition function of the reference value transmitter and the excitation current course of the brake magnet of the inventive start control apparatus.

Upon attaining an excitation current $i_O$, following a time span corresponding to a response delay $t_A$, the magnetic force begins to act upon the brake spring BF (time IV, FIGS. 4 and 5). Beginning with this point in time the braking moment TB2 decreases proportionally to the linearly ascending excitation current $i_{err}$, so that after overcoming the motor start-up moment TM there is produced by means of the brake moment TB2 a linearly ascending resultant starting moment TR2=TM+TB2 (FIG. 4). After at a time of, for instance, 0.5 seconds there has been terminated the complete lifting of the holding brake BR of the starting operation (time V, FIG. 4), so that the drive can run-up to the rated velocity.

Figure 2:
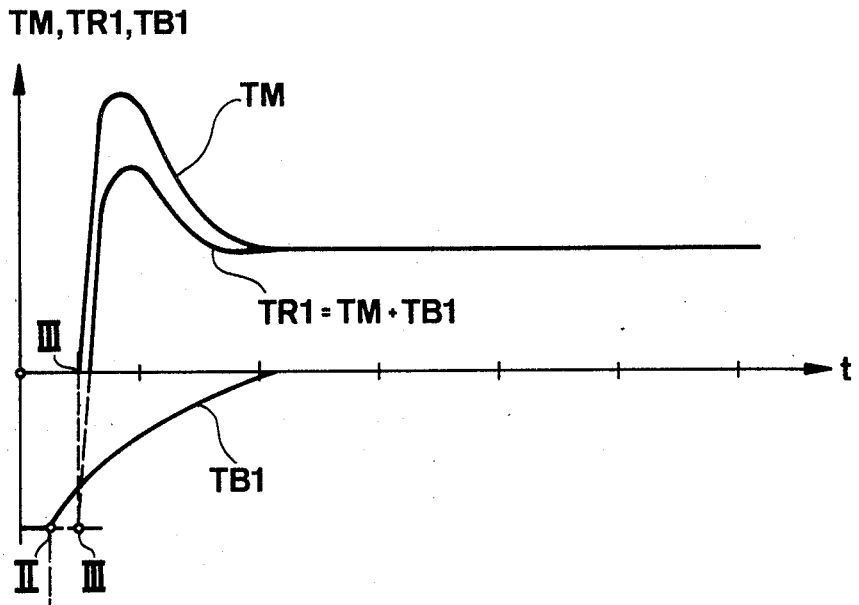
FIG. 2 is a diagram of the momentary course during driving of the elevator without a start control apparatus.
Figure 3:
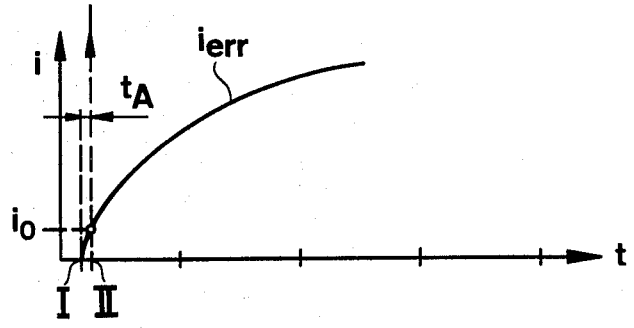
FIG. 3 is a diagram of the excitation current course of the brake magnet during driving of the elevator without a start control apparatus.

During elevator start-up without the use of the inventive start control apparatus, upon closing the contact SB of the brake protection BS (time I, FIG. 3) the excitation current $i_{err}$ of the brake magnet BM at the beginning ascends relatively sharply, so that the current value $i_O$ is reached already after an extremely small response delay $t_A$ (time II, FIGS. 2 and 3). From this time on the brake moment TB1 is decreased proportionally to the excitation current $i_{err}$ which has a course according to an e-function, and there prevails a resultant start moment TR1=TM+TB1 deviating only slightly from the start moment TM of the drive motor MG which begins to run at time III (FIG. 2), and thus there results an insufficient elevator start-up comfort.

While there are shown and described present preferred embodiments of the invention, it is to be distinctly understood that the invention is not limited thereto, but may be otherwise variously embodied and practiced within the scope of the following claims. Accordingly,

What I claim is:

1. A start control apparatus, especially for an elevator, comprising:

an elevator drive motor which can be turned-on by means of closing contacts of a mains protection;

an electromechanical holding brake containing at least one brake magnet and one brake spring;

means defining a voltage source having a first terminal and a second terminal;

said brake magnet having a first terminal and a second terminal;

a brake protection having a closing contact for connecting said first terminal of said brake magnet with said first terminal of said voltage source and for energizing the brake magnet upon turning-on the elevator drive motor and for lifting-off the holding brake against the force of the brake spring;

a regulation device with which there is operatively connected said brake magnet;

said regulation device having a reference value transmitter;

said reference value transmitter having an input;

said input of said reference value transmitter being connected by means of the closing contact of the brake protection with said first terminal of said voltage source;

a switching transistor having a collector and serving as an adjustment element of said regulation device; and said second terminal of said brake magnet being connected with said collector of said switching transistor, by means of which there can be connected said brake magnet with said second terminal of said voltage source.

2. The start control apparatus as defined in claim 1, wherein:

said brake protection contains a further closing contact which is connected with the mains protection and by means of which the mains protection can be energized, so that upon turning-on the elevator drive motor the closing contacts of the mains protection are switchable at a point in time after the closing contacts of the brake protection and the reference value transmitter begins to function prior to the start of the elevator drive motor.

3. The start control apparatus as defined in claim 1, wherein:

said reference value transmitter is structured to have a transfer function which approximately corresponds to the time behaviour of a PI-regulator.

4. The start control apparatus as defined in claim 1, wherein:

said regulation device contains a two-point regulator which controls said switching transistor as a function of regulation deviations.

5. The start control apparatus as defined in claim 1, wherein:

said regulation device further includes:

an actual value transmitter;

said actual value transmitter containing an amplifier having two inputs and a measuring resistor;

said switching transistor having an emitter;

said measuring resistor being connected with the emitter of the switching transistor and with one input of the amplifier;

said measuring resistor being connected with the second terminal of the voltage source and the other input of the amplifier; and during the cut-on time of the switching transistor there can be derived a current actual value from the current flowing through the measuring resistor.

6. The start control apparatus as defined in claim 5, wherein:

the amplifier of the actual transmitter comprises an operational amplifier which can be programmed by means of RC-elements;

a diode connected in parallel to said brake magnet; and the current flowing through the brake magnet and the diode, during the blocking time of the switching transistor, then being simulated and used as the current actual value.

7. The start control apparatus as defined in claim 1, wherein:

the brake spring is pre-biased such that the mechanical brake moment, during halt of the elevator, amounts to approximately 3-fold to 3.5-fold of the drive motor rated moment.

* * * * *